United States Patent [19]

Smith

[11] Patent Number: 5,015,510

[45] Date of Patent: May 14, 1991

[54] BRACKET FOR MOUNTING FOLDABLE BRANCHES TO AN ARTIFICIAL TREE

[75] Inventor: Sherman Smith, Newburgh, N.Y.

[73] Assignee: Hudson Valley Tree, Inc., Newburgh, N.Y.

[21] Appl. No.: 581,170

[22] Filed: Sep. 10, 1990

Related U.S. Application Data

[63] Continuation of Ser. No. 378,371, Jul. 11, 1989, abandoned.

[51] Int. Cl.[5] ..... A47G 33/06

[52] U.S. Cl. ..... 428/18; 211/196; 211/205

[58] Field of Search ..... 211/196, 205; 362/123; 428/8, 18, 19, 20–24

[56] References Cited

U.S. PATENT DOCUMENTS

| | | | |
|---|---|---|---|
| 1,148,208 | 7/1915 | Allison | 428/24 X |
| 1,694,974 | 12/1929 | Glover | 428/8 |
| 2,826,845 | 3/1958 | Warren | 428/20 X |
| 3,115,435 | 12/1963 | Abramson | 428/8 |
| 3,131,112 | 4/1964 | Abramson | 428/8 |
| 3,159,523 | 12/1964 | Abramson | 428/8 |
| 3,603,780 | 9/1971 | Lu | 428/20 X |
| 3,728,202 | 4/1973 | Baus et al. | 428/18 X |
| 3,806,399 | 4/1974 | Cocjin | 428/20 X |
| 3,813,277 | 5/1974 | Kleiman | 428/20 X |
| 3,829,349 | 8/1974 | Hermanson | 428/20 X |
| 3,970,834 | 7/1976 | Smith | 428/20 X |
| 4,109,345 | 8/1978 | Sargent et al. | 428/18 X |
| 4,140,823 | 2/1979 | Weskamp | 428/20 X |
| 4,248,916 | 2/1981 | Chase | 428/20 X |
| 4,273,814 | 6/1981 | Koehler | 428/20 X |
| 4,291,075 | 9/1981 | Puleo | 428/20 X |
| 4,343,842 | 8/1982 | Chase | 428/20 X |
| 4,447,279 | 5/1984 | Boisvert et al. | 156/61 |
| 4,451,510 | 5/1984 | Boisvert et al. | 428/20 X |
| 4,468,421 | 8/1984 | Wang | 428/20 X |
| 4,496,615 | 1/1985 | Huang | 428/20 X |

*Primary Examiner*—Henry F. Epstein

*Attorney, Agent, or Firm*—Hopgood, Calimafde, Kalil, Blaustein & Judlowe

[57] ABSTRACT

An apparatus for mounting artificial tree branches to an artificial tree trunk. A series of bracket guideways are adapted for pivotal engagement with a plurality of branch members for movement of each member between stowed and operative positions. Each branch engages a guideway notch which suspends the branch in an operative position radially from the tree trunk. As each branch member moves between stowed and operative positions, a guideway slot receives one leg of a branch so as to enable its elbow to pass through the guideway. Upon moving the branches into a stowed or an operative position, each branch member engages a guideway slot or notch, respectively, restricting radial rotation of the branch.

16 Claims, 1 Drawing Sheet

BRACKET FOR MOUNTING FOLDABLE BRANCHES TO AN ARTIFICIAL TREE

This application is a continuation, of application Ser. No. 378,371, filed July 11, 1989.

BACKGROUND AND SUMMARY OF INVENTION

This invention relates to apparatus for mounting foldable artificial tree branches to an artificial tree trunk.

Artificial trees are generally comprised of a long pole or artificial tree trunk having branch members mounted radially along the length thereof to simulate the appearance of a live tree. These branch members are detachably mounted to brackets affixed to the artificial tree trunk to facilitate removal of the branches and storage of the artificial tree. Although the branch members may be mounted to and removed from the artificial tree trunk, the task of assembling or disassembling an artificial tree having a multitude of branches every year is a monotonous and time consuming task. Another disadvantage of conventional artificial trees is that separation of the branch members from the tree trunk increases the likelihood of loss of or damage to the branches.

Other artificial trees have branch mounting brackets which affixedly mount branch members for movement between retracted and extended positions. However, the mechanisms for latching the branches in either position often fail causing the branch to flop about the bracket and rotate radially. As a consequence, transporting the tree becomes difficult even when the branches are in the retracted position. In addition, the conventional wire branch construction of artificial tree branches is very susceptable to bending or even breakage. When in the extended position, a broken or uneven branch detracts from the full appearance of the tree.

A few prior artificial tree structures are shown, for example, in U.S. Pat. Nos. 3,115,435 issued to Abramson, 3,131,112 issued to Abramson, 4,248,916 issued to Chase and 4,343,842 issued to Chase.

Accordingly, it is desirable that artificial trees be stored without disassembly of the branch members from the tree trunk. It is also desirable that the branch members be suitably constructed and mounted to the artificial tree trunk in a manner which prevents radial rotation or bending of the members in either the retracted or extended position. In addition, it is desirable that the branch mounting brackets have reliable means for securing the branches in the extended position.

The present invention is directed to an artificial tree assembly including a bracket for mounting artificial tree branches to an artificial tree trunk. A series of bracket guideways defining apertures are adapted for pivotal engagement with a plurality of branch members for movement of each member between stowed and operative positions. Each branch engages a guideway notch which suspends the branch in the operative position radially from the tree trunk. As the branch members move between stowed and operative positions, each guideway slot receives one leg of each branch so as to enable its elbow to pass through the guideway. Upon moving the branches to a stowed position, the branch members engage guideway slots preventing rotation of the branch. In the operative position, side portions of each notch restrict radial rotation of the branches.

Accordingly, it is an object of this invention to provide an improved bracket for mounting foldable artificial tree branches to an artificial tree trunk.

It is a further object of this invention to provide an artificial tree branch mounting bracket which simplifies the set-up of artificial trees.

It is another object of this invention to provide an artificial tree branch mounting bracket which enables quick and easy storage of artificial trees.

It is a further object of this invention to provide a reliable bracket for the one-time mounting of foldable branches to an artificial tree trunk.

BRIEF DESCRIPTION OF THE DRAWINGS

For a better understanding of this invention, reference is made to the following drawings which are to be taken in conjunction with the detailed description to follow.

DESCRIPTION OF THE PREFERRED EMBODIMENT

The present invention relates to a fold-up artificial tree bracket assembly 10 for mounting artificial tree branches to an artificial tree, for example, an artificial Christmas tree, the bracket assembly comprising branch members 30, each having an elbow 34 for pivotal engagement with a bracket 11 upon movement of each member between a stowed and an operative position, means for guiding each branch member as the member pivots about its elbow between the stowed and operative positions, means for suspending the branch members radially from the bracket in the operative position and means for restricting movement of the members about the bracket when in the stowed and operative positions.

Figure 1:
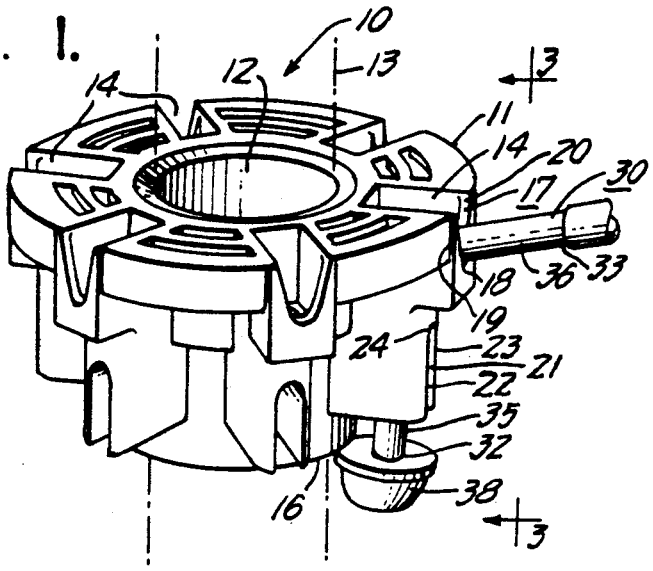
FIG. 1 is a perspective view of the major components of the bracket for artificial tree branches.
Figure 2:
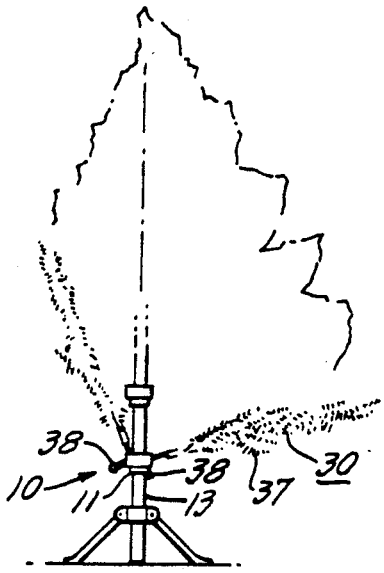
FIG. 2 is a side view of the bracket of the present invention mounted to an artificial tree trunk.
Figure 3:
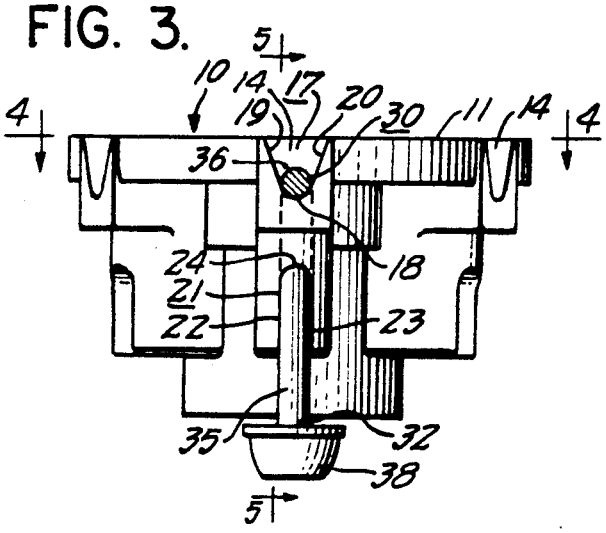
FIG. 3 is a sectional view of the apparatus of FIG. 1 taken along line 3—3.

More specifically, FIG. 1 illustrates an improved bracket 10 for mounting artificial branches to an artificial tree trunk constructed in accordance with the present invention. The bracket structure 11 has an annular shape with a hole 12 through its center for receiving a pole or an artificial tree trunk 13 and to facilitate the selective positioning of the bracket at intervals along the length of the trunk. At the factory, each bracket is moved to a desired position on the tree trunk, as shown in FIG. 2, and is then secured thereto using suitable fasteners.

Referring again to FIG. 1, the bracket structure also includes a series of guideways or passageways 14 along the peripheral edge of its annular structure defining apertures for receiving branch members or artificial tree branches 30. Each passageway 14 comprises a hollow cylinder 15, as best seen in FIG. 5, having apertures 39 and 40 at each end, respectively, for receiving a branch member 30 and to facilitate movement of the branch along the passageway between the stowed and operative positions.

Figure 5:
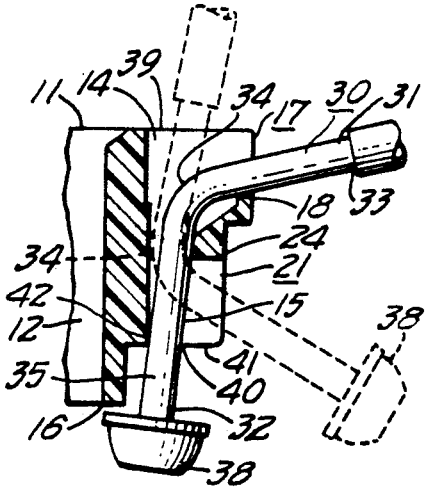
FIG. 5 is a sectional view taken along line 5—5 of FIG. 3 showing a branch in the stowed and operative positions.
Figure 6:
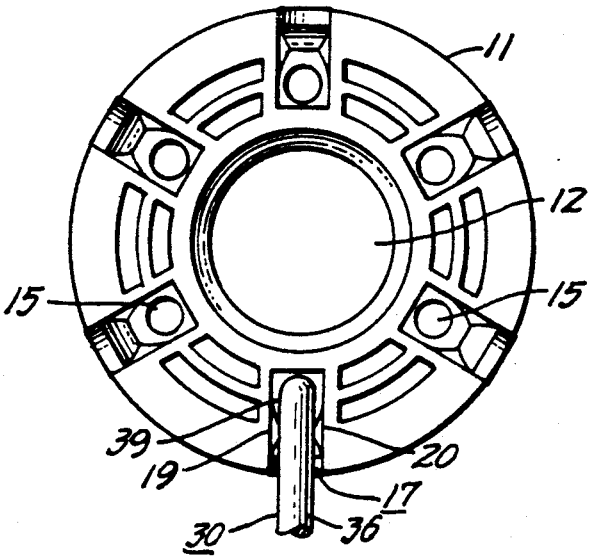
FIG. 6 is a sectional view of the apparatus of FIG. 3 taken along line 4—4.

As best seen in FIG. 5, each branch 30 comprises a rod having a bend, for example approximately 90 degrees, between its first and second ends, 32 and 33 respectively. The bend is proximate to first end 32 and forms an elbow 34. The elbow divides the branch into a branch limiting member such as first or shorter leg 35 and a second or longer leg 36. Longer leg 36 of the branch mounts supporting surfaces such as soft or hard bristles 37 thereon to simulate the appearance of a living tree branch, as shown in FIG. 2. These supporting surfaces also limit movement of the branch through the passageway when the branch is in a stowed position.

Although the elbow is depicted in the drawings as having a bend of approximately 90 degrees, it is understood that the angle formed at the elbow may be varied so as to achieve any desired appearance of the tree; provided, however that heavy duty branch construction is used so that firm support of the branch is provided at any selected angle.

As best seen in FIGS. 1 and 5, shorter leg 35 cooperates with passageway 14 so as to suspend branch 30 radially from the bracket. A catch 38 is mounted to the first end of the branch adjacent to its shorter leg. Catch 38 serves to engage a passageway shoulder or seat 41 at the lower edge of the passageway and thereby limits movement of the branch through the passageway. In this manner, the catch prevents the branch from falling out of the passageway upon radial suspension from bracket 11.

As shown in FIGS. 1 and 3–6, each passageway 14 has a notch 17 located on the outer edge of its upper end. Each notch 17 forms a seat 18 (Not shown in FIG. 6) for receiving a portion of the branch longer leg 36 proximate to elbow 34. The upper end of the passageway communicates with the notch to enable the longer leg to move freely from the notch to the open upper end of the passageway. The notch has side portions 19 and 20 (Not shown in FIG. 5) which, upon engagement with branch 30, direct the longer leg outward from the bracket and prevent the branch from rotating about the central axis of passageway 14 when the branch is in the horizontal or operative position. Thereby, the branch is prevented from swinging about or from being off-center and creating bare spots in the tree.

Upon contact of branch longer leg 36 with notch seat 18 and shorter leg 35 with a stop or the inbound edge 42 of aperature 40, each tree branch may be suspended radially from the tree trunk whereby the branches are in the operative position, as shown in FIG. 5 by solid lines.

Each catch comprises a cap or disk having a diameter greater than that of the branch to which it is mounted so as to enable an edge of the catch to firmly contact the passageway seat and limit movement of the branch through the passageway when in the operative position.

Although each catch may engage shoulder 41 at the lower end of the passageway, as shown in FIG. 5, it is understood that other portions of the bracket may, in the alternative, serve to secure the catch for limiting the movement of each branch. For example, each catch may engage an annular edge bracket seat 16 adjacent aperture 12 at the lower end of the bracket, as shown in FIG. 1.

As shown in FIGS. 1 and 3–5, each passageway also includes a slot 21 in communication with the outer edge of the passageway lower end so as to enable shorter leg 35 to move freely into and out of engagement with the passageway and the slot. This permits movement of the branch to a vertical or stowed position. The slot also extends a substantial distance from the lower end thereof along the length of the passageway. This provides sufficient clearance to the shorter leg for the branch to pivot about its elbow 34 upon movement between the stowed and operative positions, as shown in FIG. 5.

Figure 4:
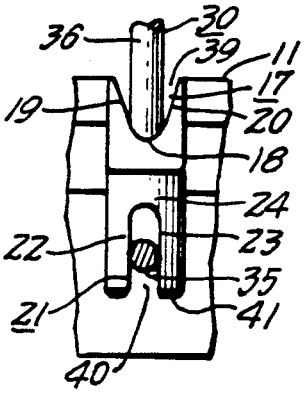
FIG. 4 is a front sectional view of the apparatus of FIG. 3 showing the branch in the stowed position.

As best seen in FIG. 4, each slot 21 has sides 22 and 23 which hold the shorter leg outward and limit sideways movement of the branch shorter leg. In effect, the sides 22 and 23 restrict rotation of the branch about the central axis of the passageway thereby preventing the branch from swinging about when transporting the tree.

Referring now to FIG. 5, in operation, beginning from the stowed or vertical position where the branches are generally parallel to artificial tree trunk 13, each branch 30 must be rotated about notch 17 in a generally clockwise fashion to place the branches in the operative position. As each branch moves toward the operative position, the shorter leg slides out of engagement with its corresponding slot and, concurrently therewith, the longer leg engages the passageway notch. Upon contact of the longer leg with the notch seat and the shorter leg with the inbound edge of aperature 40, the branch is in the operative position, as shown in solid lines.

As the branch is moved toward the operative position, the branch elbow 34 clears the linear passageway of the bracket by its clockwise pivotal movement about an edge or end 24 of the slot nearest the center of the passageway. In effect, the shorter leg of the branch tilts continuously as it slides through the slot upon movement toward a position generally parallel with the passageway. The slot has a suitable length to provide space for sliding and tilting of the shorter leg. This length effectively allows the elbow to pivot and clear the inside diameter of the passageway.

For retracting the branches for storage of the tree, the branches must be moved counterclockwise toward the vertical or stowed position. Upon counterclockwise movement, the longer leg of each branch disengages from notch 17. As the longer leg disengages from seat 18, the shorter leg engages and slides into the passageway slot. The length of the slot again enables the branch elbow to pivot, here counterclockwise, about the edge 24 of the slot nearest the center of the passageway and thereby clear its inside diameter. When the branch longer leg attains a position generally parallel with the tree trunk, the shorter leg is in full engagement with passageway slot 21. With the shorter leg generally perpendicular to the passageway, the branch is now in the stowed position, as shown by dashed lines.

When the branches are in the stowed position, artificial bristles 37 mounted to the longer leg thereof prevent the branch from sliding downward through the passageway when the artificial tree is in a vertical position. In addition, the engagement of the branch shorter leg with the passageway slot restricts radial rotation of the branch.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A bracket for mounting foldable artificial tree branches to an artificial tree trunk comprising:

(a) at least one branch member having an elbow for pivotal engagement with said bracket upon movement of said member between a stowed and an operative position;

(b) means for guiding said branch member as said member pivots between the stowed and operative positions, said guiding means enabling said elbow to pivot upon movement of said member through said means;

(c) means for suspending of said branch member radially from said bracket in the operative position;

(d) means for restricting movement of said member about said bracket when in the stowed and operative positions; and (e) means for limiting movement of said member through said guiding means when in the stowed and operative positions.

2. The bracket set forth in claim 1 wherein said guiding means includes at least one passageway enabling said elbow to pivot upon movement of said member through said passageway.

3. The bracket set forth in claim 2 wherein said suspending means comprises a seat associated with said bracket, whereupon movement of said branch member from the stowed to the operative position, said member engages said seat so as to suspend said member radially from said bracket.

4. The bracket set forth in claim 3 wherein said limiting means includes bristles associated with said branch member for restricting movement of said member along said passageway when the member is in the stowed position.

5. The bracket set forth in claim 4 wherein said limiting means further comprises a catch associated with said branch member for restricting movement of said member along said passageway when the member is in the operative position.

6. The bracket set forth in claim 5 wherein said branch member includes a first leg and a second leg having said elbow therebetween, said first leg mounting said catch and said second leg mounting said bristles.

7. The bracket set forth in claim 6 wherein said suspending means further comprises a notch associated with each passageway, said notch having a seat whereupon engagement with said branch member, said notch seat suspends said member radially from said bracket, said branch member being in the operative position.

8. The bracket set forth in claim 7 wherein said passageway includes a slot for receiving said first leg as said elbow moves through said passageway, upon movement of said branch member between the stowed and operative positions.

9. The bracket set forth in claim 8 wherein said restricting means includes sides associated with said slot, whereupon engagement of said first leg with said slot, said sides limit rotation of said branch member about said bracket.

10. The bracket set forth in claim 9 wherein said restricting means further include side portions associated with said notch, whereupon engagement of said branch member with said notch seat, said side portions limit rotation of the branch member about said bracket.

11. The bracket set forth in claim 10 whereupon movement of said branch member from the operative to the stowed position, as said member pivots about said elbow said first leg encounters and engages said guiding slot, said member being in the stowed position.

12. The bracket set forth in claim !1 wherein said passageway is adapted for sliding engagement with said branch member, said slot having a selected length so as to permit said elbow to clear said passageway end as said first leg pivots about said end and engages said slot, upon movement of said member between the stowed and operative positions.

13. A fold up artificial tree assembly for mounting artificial tree branches, comprising:

a tree trunk, at least one branch member, and bracket means for supporting each of said branch members in a stowed and an operative position, said branch member having a branch end and a branch leg arm forming an angled elbow, said branch leg supporting the branch pieces, said bracket means having aperture means to receive said branch members and to enable said branch member to pivot between a stowed and an operative positive, said bracket means supporting branch member to thereby prevent said branch member from falling out of the artificial tree assembly, and said branch member also having branch holding means to limit relative movement of said branch member relative to said bracket means to assist in supporting said branch member.

14. The tree assembly of claim 13 in which said bracket means includes supporting surfaces to limit downward movement, but to allow pivoting movements, and said branch member includes a limiting member presenting a surface to limit upward movement.

15. The tree assembly of claim 14 in which said bracket means and branch members having restraining elements coupled to the first leg to secure the branch from falling out but to allow pivotal movement.

16. The tree assembly of claim 15 in which the branch limiting member of said branch includes a catch.

* * * * *